US009970235B2

(12) United States Patent
Lacour

(10) Patent No.: US 9,970,235 B2
(45) Date of Patent: May 15, 2018

(54) ROTARY STEERABLE DRILLING SYSTEM FOR DRILLING A BOREHOLE IN AN EARTH FORMATION

(71) Applicant: Bertrand Lacour, Daillens (CH)

(72) Inventor: Bertrand Lacour, Daillens (CH)

( * ) Notice: Subject to any disclaimer, the term of this patent is extended or adjusted under 35 U.S.C. 154(b) by 246 days.

(21) Appl. No.: 14/054,788

(22) Filed: Oct. 15, 2013

(65) Prior Publication Data

US 2014/0102800 A1 Apr. 17, 2014

Related U.S. Application Data

(60) Provisional application No. 61/714,161, filed on Oct. 15, 2012.

(51) Int. Cl.

| | |
|---|---|
| ***E21B 7/06*** | (2006.01) |
| ***E21B 7/04*** | (2006.01) |
| ***E21B 41/00*** | (2006.01) |

(52) U.S. Cl.
CPC ..... *E21B 7/06* (2013.01); *E21B 7/04* (2013.01); *E21B 41/0085* (2013.01)

(58) Field of Classification Search
CPC ..... E21B 41/0085; E21B 7/04–7/10
See application file for complete search history.

(56) References Cited

U.S. PATENT DOCUMENTS

| | | | | |
|---|---|---|---|---|
| 3,743,034 | A * | 7/1973 | Bradley | E21B 7/06 175/61 |
| 6,340,063 | B1 | 1/2002 | Comeau et al. | |
| 6,581,699 | B1 | 6/2003 | Chen et al. | |
| 7,188,685 | B2 | 3/2007 | Downton et al. | |
| 7,407,020 | B2 | 8/2008 | Gleitman et al. | |
| 7,942,214 | B2 | 5/2011 | Johnson et al. | |
| 7,980,328 | B2 | 7/2011 | Hallworth et al. | |
| 1,030,885 | A1 | 12/2011 | Menger et al. | |
| 2001/0022241 | A1 * | 9/2001 | Portman | E21B 4/006 175/61 |
| 2002/0043372 | A1 | 4/2002 | Cargill et al. | |

(Continued)

FOREIGN PATENT DOCUMENTS

| | | |
|---|---|---|
| AU | 2003200408 | 4/2003 |
| AU | 2003200410 | 4/2003 |

(Continued)

OTHER PUBLICATIONS

Schlumberger website accessed Oct. 22, 2013 www.slb.com services drilling directional (for PDX6).

(Continued)

*Primary Examiner* — Robert E Fuller
*Assistant Examiner* — Steven A MacDonald
(74) *Attorney, Agent, or Firm* — Thrive IP; Peter L. Brewer

(57) ABSTRACT

A bottom hole assembly for drilling a deviated wellbore is provided. The bottom hole assembly includes a drill bit and a connected rotary steerable drilling system, or RSS. The RSS includes one or more orientation sensors, a steering unit configured to direct a force through the drill bit and against a rock formation, control electronics designed to send control signals to the steering unit, and power electronics. The steering unit transforms electrical power to linear displacement and force using linear actuators acting off-center to the longitudinal axis of the drill string.

21 Claims, 7 Drawing Sheets

(56) References Cited

U.S. PATENT DOCUMENTS

| | | | | |
|---|---|---|---|---|
| 2002/0139584 | A1 | 10/2002 | Hughes et al. | |
| 2002/0185314 | A1 | 12/2002 | Cargill et al. | |
| 2002/0195278 | A1 | 12/2002 | Vandenberg et al. | |
| 2003/0010534 | A1 | 1/2003 | Chen et al. | |
| 2003/0121702 | A1* | 7/2003 | Downton | E21B 7/067 175/76 |
| 2004/0112640 | A1 | 6/2004 | Hay et al. | |
| 2005/0056463 | A1* | 3/2005 | Aronstam | E21B 7/062 175/61 |
| 2005/0061549 | A1 | 3/2005 | Evans et al. | |
| 2006/0266555 | A1 | 11/2006 | Chen et al. | |
| 2007/0289373 | A1 | 12/2007 | Sugiura | |
| 2008/0115974 | A1* | 5/2008 | Johnson | E21B 10/322 175/61 |
| 2009/0044977 | A1 | 2/2009 | Johnson et al. | |
| 2009/0188720 | A1 | 7/2009 | Johnson et al. | |
| 2009/0194334 | A1 | 8/2009 | Johnson et al. | |
| 2009/0321139 | A1 | 12/2009 | Strachan | |
| 2010/0038141 | A1* | 2/2010 | Johnson | E21B 7/064 175/57 |
| 2010/0101867 | A1 | 4/2010 | Sindt et al. | |
| 2010/0139983 | A1 | 6/2010 | Hallworth et al. | |
| 2010/0303570 | A1 | 12/2010 | Denoix et al. | |
| 2011/0017473 | A1 | 1/2011 | Clarkson et al. | |
| 2011/0139508 | A1 | 6/2011 | Haugvaldstad et al. | |
| 2011/0139512 | A1 | 6/2011 | Haugvaldstad et al. | |
| 2011/0259645 | A1 | 10/2011 | Tulloch et al. | |
| 2011/0308858 | A1* | 12/2011 | Menger | E21B 7/067 175/24 |
| 2012/0018224 | A1* | 1/2012 | Johnson | E21B 10/62 175/61 |
| 2012/0139748 | A1* | 6/2012 | Hay | E21B 47/09 340/854.1 |
| 2012/0160563 | A1* | 6/2012 | Clark | E21B 7/06 175/61 |
| 2013/0146366 | A1* | 6/2013 | Cheng | C21D 6/001 175/341 |

FOREIGN PATENT DOCUMENTS

| | | |
|---|---|---|
| AU | 2003248325 | 10/2003 |
| AU | 2005209690 | 9/2005 |
| AU | 2007202838 | 7/2007 |
| CA | 2564116 | 1/2001 |
| CA | 2569070 | 1/2001 |
| CA | 2348554 | 11/2001 |
| CA | 2578828 | 11/2002 |
| CA | 2545765 | 5/2006 |
| CA | 2532618 | 7/2006 |
| CA | 2539668 | 9/2006 |
| CA | 2586298 | 10/2007 |
| CA | 2590309 | 11/2007 |
| CA | 2610186 | 5/2008 |
| EP | 1231014 | 8/2002 |
| EP | 1400654 | 3/2004 |
| GB | 2328964 | 3/1999 |
| GB | 2347951 | 9/2000 |
| GB | 2388911 | 11/2003 |
| GB | 2393196 | 3/2004 |
| GB | 2408990 | 6/2005 |
| GB | 2409220 | 6/2005 |
| GB | 2412388 | 9/2005 |
| GB | 2415972 | 1/2006 |
| GB | 2427632 | 1/2007 |
| GB | 2438289 | 11/2007 |
| GB | 2444817 | 6/2008 |
| GB | 2444938 | 6/2008 |
| GB | 2450681 | 1/2009 |
| GB | 2457604 | 11/2011 |
| GB | 2483022 | 2/2012 |
| GC | 0000115 | 6/2005 |
| MX | PA02004500 | 7/2004 |
| WO | WO03052237 | 6/2003 |
| WO | WO2004099556 | 11/2004 |
| WO | WO2005099424 | 10/2005 |
| WO | WO2008097843 | 8/2008 |
| WO | WO2009002996 | 12/2008 |
| WO | WO2009134842 | 11/2009 |
| WO | WO2010064002 | 6/2010 |
| WO | WO2011158111 | 12/2011 |
| WO | WO2011160027 | 12/2011 |
| WO | WO2012012624 | 1/2012 |
| WO | WO2012023043 | 2/2012 |

OTHER PUBLICATIONS

Schlumberger website accessed Oct. 22, 2013 www.slb.com services drilling directional (for PDX5).

Schlumberger website accessed Oct. 22, 2013 www.slb.com services drilling directional (for Power Drive Xceed).

Schlumberger website accessed Oct. 22, 2013 www.slb.com services drilling directional (for Power Drive vortex).

Schlumberger website accessed Oct. 22, 2013 www.s1b.com services drilling directional (for Power Drive Archer).

Piezo Mechanik website accessed Sep. 21, 2012 www.piezomechanik.com/cn/home/contact.

Piezo Mechanik website accessed Sep. 21, 2012 www.piezomechanik.com/cn/home/products.

Halliburton website accessed Oct. 22, 2013 www.halliburton/en-us/ps/sperry/drilling (for GeoPilot).

Halliburton website accessed Oct. 22, 2013 www.halliburton/en-us/ps/sperry/drilling (for EZ Pilot).

Schlumberger website accessed Oct. 22, 2013 www.slb.com services drilling directional (PDX6).

Schlumberger website accessed Oct. 22, 2013 www.slb.com services drilling directional (PDX5).

Piezo Mechanik website accessed Sep. 21, 2012 www.piezomechanik.com/cn/home/contact (for Power Drive Archer).

Baker Hughes website accessed Oct. 22, 2013 www.bakerhughes.com/products-and-services (for AutoTrak).

Baker Hughes website accessed Oct. 22, 2013 www.bakerhughes.com/products-and-services (for Curve).

Weatherford website accessed Oct. 22, 2013 www.weatherford.com/weaterford/group (for Revolution).

* cited by examiner

ROTARY STEERABLE DRILLING SYSTEM FOR DRILLING A BOREHOLE IN AN EARTH FORMATION

CROSS REFERENCE TO RELATED APPLICATIONS

This application claims the benefit of U.S. Patent Application No. 61/714,161 filed Oct. 15, 2012. That application is entitled "Rotary Steerable Drilling System for Drilling a Borehole in an Earth Formation," and is incorporated herein in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of hydrocarbon recovery operations. More specifically, the present invention relates to rotary steerable drilling systems and methods for use of rotary steerable devices for the formation of boreholes in an earth formation.

Technology in the Field of the Invention

In the drilling of oil and gas wells, a wellbore is formed using a drill bit that is urged downwardly at a lower end of a drill string. In most instances, the drill bit is rotated in response to torque that is applied to the drill string at the drilling rig. The rotational force applied to the drill string is transmitted to the drill bit in order to impart a grinding force against the rock face downhole. Such a process is commonly used in vertically-completed wellbores, and is referred to as "rotary drilling."

In conventional rotary drilling operations, the drilling rig rotates a drill string comprised of tubular joints of drill pipe connected end-to-end. The drill bit is connected to the lower end of the drill string.

In some instances of rotary drilling, the drill bit is part of a bottom hole assembly that includes mud motors. During drilling operations, a drilling fluid, commonly referred to as drilling mud, is pumped down the interior bore of the drill pipe, across the mud motors, through the drill bit, through an annular region formed between the drill string and the surrounding formation, and back to the surface. In this instance, the mud motors are used to rotate the drill bit without rotation of the drill string.

In wellbores that are deviated or horizontally-completed, a special bottom-hole assembly is employed. The bottom-hole assembly allows the operator to control or "steer" the direction of the bit. This is commonly done by applying an eccentric force to the drill bit, causing the rock face to be cut along a desired azimuth. Such an operation is referred to as "directional" drilling.

In directional drilling, pressurized mud is pumped down the interior of the drill string and is used to power the mud motors. The mud motors, in turn, are mechanically coupled to and turn the nearby drill bit. The mud motors are used with stabilizers or bent subs to impart an angular deviation to the drill bit. This, in turn, deviates the well from its previous path and in the desired azimuth and/or inclination.

There are several advantages to directional drilling. These primarily include the ability to complete a wellbore along a substantially horizontal axis of a subsurface formation, thereby exposing a substantially greater formation face. A formation fracturing operation may be conducted to further expose the formation to the wellbore. Advantages also include the ability to penetrate into subsurface formations that are not located directly below the wellhead. This is particularly beneficial where an oil reservoir is located under an urban area or under a body of deep water. Another benefit of directional drilling is the ability to group multiple wellheads on a single platform, such as for offshore drilling. Finally, directional drilling enables multiple laterals and/or sidetracks to be drilled from a single wellbore in order to maximize reservoir exposure and recovery of hydrocarbons.

Directional drilling is generally performed using downhole rotary steerable drilling systems, or "RSS." In the oil and gas industry, a select few companies compete in the RSS market. These companies generally represent large service companies, although a few smaller companies are currently in operation. None of these companies actually sell their RSS equipment; rather, they provide the equipment at the drill site and oversee the drilling operation as a service. Once the wellbore is formed and the well is completed, the engineers return to their base and store their RSS tools for later use.

The known bottom hole assemblies used for RSS each include a steering unit. The steering units operate with dedicated control electronics to change a force orientation of the drill bit as the formation is penetrated. Modern RSS systems attempt to achieve a high bend angle, or high dog-leg severity ratio ("DLS"), through the steering unit. However, a high DLS creates increased strain on the steering unit, causing some units to fail at the steering unit or, perhaps, on the drill string due to material fatigue.

Therefore, a need exists for a rotary steerable drilling assembly that offers an improved ability to redirect the force orientation of a drill bit during the drilling of a deviated wellbore at higher angles of deviation. Further, a need exists for a bottom hole assembly that, in some cases, employs electrical actuation rather than solely mechanical or hydraulic actuation for generating off-center, linear forces through a drill bit and against a rock formation.

BRIEF SUMMARY OF THE INVENTION

A bottom hole assembly is provided herein. The bottom hole assembly first includes a drill bit. The drill bit is designed to cut a rock formation in a subsurface. The drill bit may be, for example, a static bit body having cutting elements fixed thereon or impregnated therein. Alternatively, the drill bit may comprise a roller-cone type drill bit having one or more roller cones.

The bottom hole assembly also comprises a rotary steerable drilling system. The rotary steerable drilling system, or RSS, is used for controlling the motion of the drill bit in order to form a deviated wellbore.

The RSS first has a power generator. The power generator generates electrical power for the RSS. Preferably, power generation is provided through a turbine that generates motion from the flow of drilling mud, and an alternator that transforms mechanical movement into electrical power.

The RSS also has one or more orientation sensors. Preferably, the orientation sensors represent a set of accelerometers and magnetometers. The accelerometers are used to determine the inclination of the RSS relative to the earth's gravity field, while the magnetometers are used to determine the inclination of the RSS relative to the earth's magnetic field.

The RSS also includes a steering unit. The steering unit serves as an actuation module for directing a force of the drill bit against the rock formation. In the present invention, a novel steering unit is provided. The steering unit transforms electrical power into off-center, linear displacement and force. In one aspect, the steering unit uses one or more linear piezo-electric actuators. In another aspect, the steering unit uses hydraulic cylinders or pistons.

The RSS further has control electronics. The control electronics send control signals to the steering unit.

The RSS also includes power electronics. The power electronics process current and voltage generated by the alternator, and transform the current and voltage into values useful for providing power to the orientation sensors and the control electronics.

A method for forming a deviated wellbore is also provided herein. The method first includes forming a vertical portion of a wellbore through an earth subsurface.

The method also includes drilling a wellbore to a kick-off point using a drill bit disposed at a lower end of a drill string.

The method further includes introducing a bottom hole assembly into the wellbore. The bottom hole assembly is in accordance with the bottom hole assembly described above in its various embodiments.

The method then includes forming a deviated portion of the wellbore.

BRIEF DESCRIPTION OF THE DRAWINGS

So that the manner in which the present invention can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
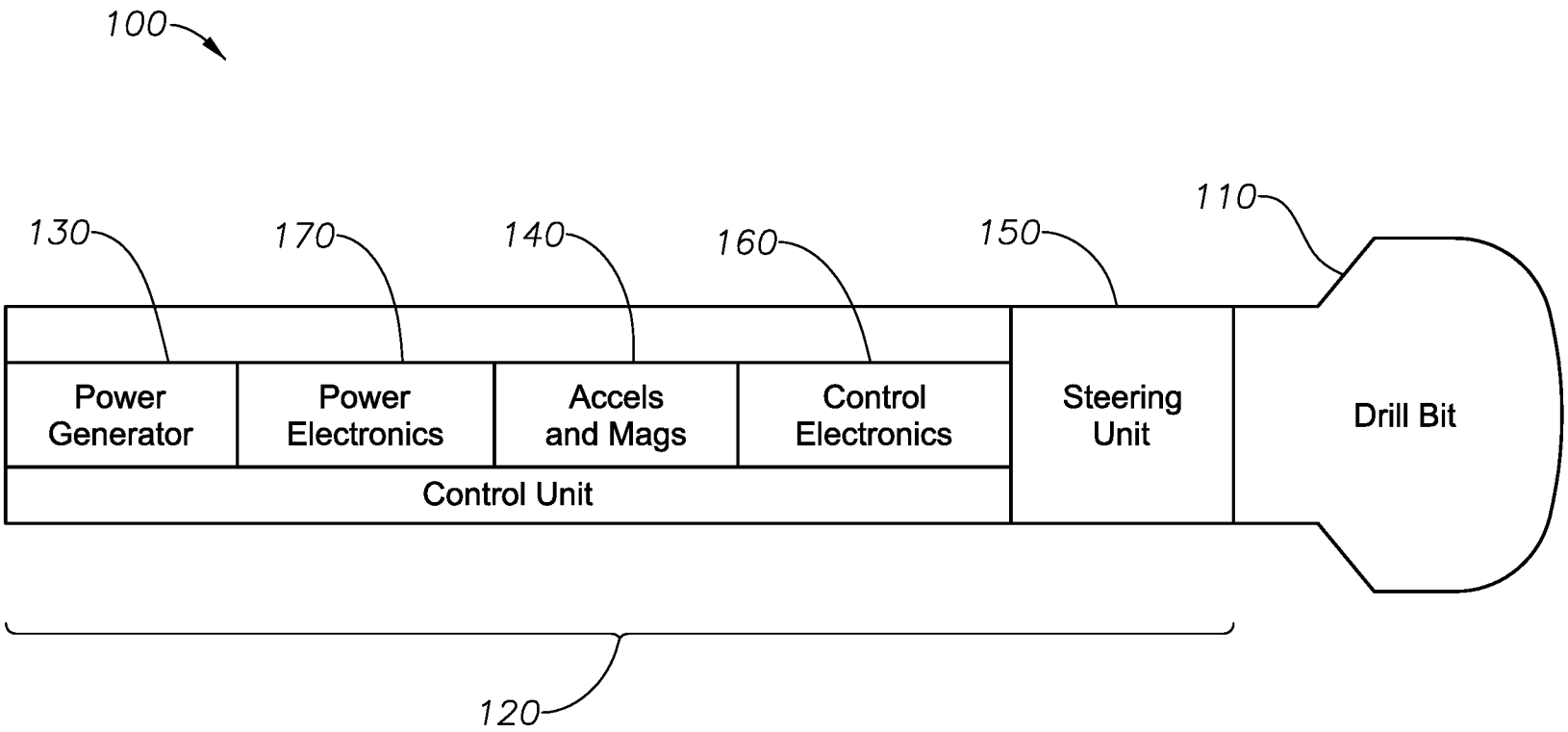
FIG. 1 is a schematic view of the bottom hole assembly of the present invention, in one embodiment.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, combinations of liquids and solids, and combinations of gases, liquids, and solids.

As used herein, the term "gas" refers to a fluid that is in its vapor phase at about 1 atm and 15° C.

As used herein, the term "oil" refers to a hydrocarbon fluid containing primarily a mixture of condensable hydrocarbons.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

The terms "zone" or "pay zone" or "zone of interest" refer to a portion of a formation containing hydrocarbons. Alternatively, the formation may be primarily a water-bearing interval.

The term "hydrocarbon-bearing formation" refers to a zone of interest or pay zone containing hydrocarbon fluids.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore."

Description of Selected Specific Embodiments

FIG. 1 provides a schematic drawing of a bottom hole assembly 100 of the present invention, in one embodiment.

The bottom hole assembly 100 first includes a drill bit 110. The drill bit 110 is designed to cut a rock formation in a subsurface. The drill bit 110 may be, for example, a static bit body having cutting elements fixed thereon or impregnated therein. Alternatively, the drill bit may comprise a roller-cone type drill bit having one or more roller cones.

The bottom hole assembly 100 also comprises a rotary steerable drilling system. The rotary steerable drilling system 120, or RSS, is used for controlling the drill bit 110 in order to form a deviated wellbore.

The RSS 120 first has a power generator 130. The power generator 130 generates electrical power for the RSS 120. Preferably, power generation is provided through a turbine that generates motion from the circulation of drilling mud, and an alternator that transforms the mechanical movement of the turbine into electrical power.

The RSS 120 also has one or more orientation sensors 140. Preferably, the orientation sensors 140 represent a set of accelerometers and magnetometers. The accelerometers are used to determine the inclination of the RSS 120 relative to the earth's gravitational field, while the magnetometers are used to determine the direction of the RSS 120 relative to the earth's magnetic field.

It is understood that various so-called "direction and inclination" sensors are known in the RSS industry. The present invention is not limited to any particular arrangement of direction and inclination sensors.

The RSS 120 may also include a gamma ray detector (not shown). The gamma ray detector provides a log that adds geological surveying capability.

The RSS 120 also includes a steering unit 150. The steering unit 150 serves as an actuation module for directing a force of the drill bit 110 against the rock formation. In the present invention, a novel steering unit 150 is provided. The steering unit transforms electrical power to linear displacement and force using a linear actuator. The actuator may be, for example, a stack of piezo-electric actuators or a hydraulic piston.

The RSS 120 further has control electronics 160. The control electronics 160 send control signals to the steering unit 150. More specifically, the control electronics 160 control the action of the steering unit 150 in open or closed loop compared to the desired wellbore trajectory.

The RSS 120 also includes power electronics 170. The power electronics 170 process current and voltage generated by the alternator, and transform the current and voltage into values useful for providing power to the orientation sensors and the control electronics.

The drill bit 110 and the RSS 120 are designed to be placed at the bottom of a drill string during a well drilling (or wellbore formation) operation. The well drilling operation is conducted using a drilling rig (or derrick) placed at a well site.

Figure 2:
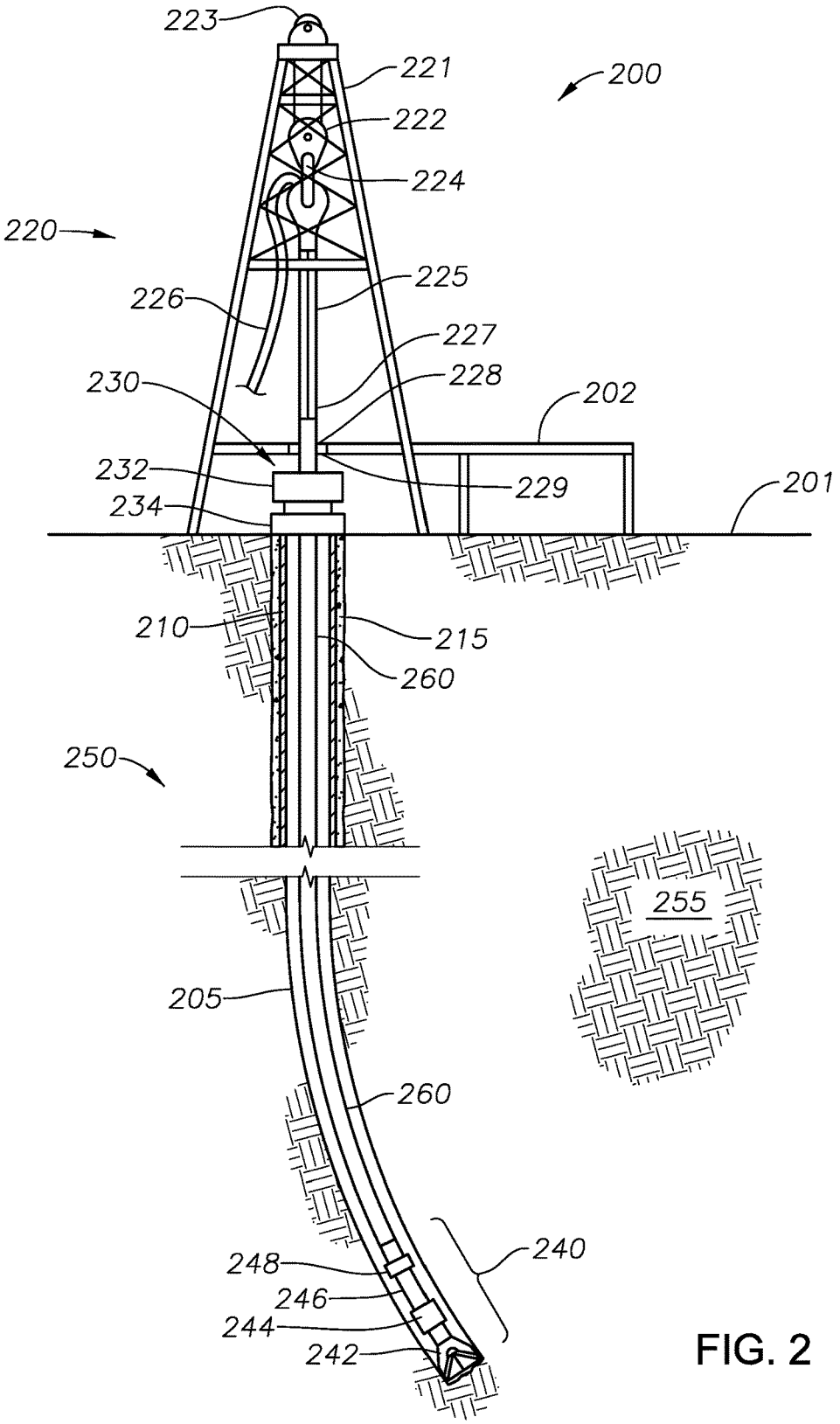
FIG. 2 is a side view of an illustrative well site and subsurface formation. A deviated wellbore has been formed through the subsurface formation using the bottom hole assembly of FIG. 1.

FIG. 2 is a side view of an illustrative well site 200. The well site 200 includes a derrick 220 at an earth surface 201, and a wellbore 250 extending from the earth surface 201 into an earth subsurface 255. The wellbore 250 is being formed using the derrick 220, a drill string 260 extending below the derrick 220, and a bottom hole assembly 240 at a lower end of the drill string 260.

Referring first to the derrick 220, the derrick 220 includes a frame structure 221 that extends up from the earth surface 201 and supports drilling equipment. The derrick 220 also includes draw works 222, a crown block 223 and a swivel 224. A so-called kelly 225 is attached to the swivel 224. The kelly 225 has a longitudinally extending bore (not shown) communicating with a kelly hose 226. The kelly hose 226, also known as a mud hose, is a flexible, steel reinforced, high pressure hose that delivers drilling fluid through the bore of the kelly 225 and down into the drill string 260.

The kelly 225 includes a drive section 227. The drive section 227 is non-circular in cross-section and conforms to an opening 228 longitudinally extending through a kelly drive bushing 229 slidably disposed on the kelly drive section 227 for rotational engagement therewith. Both linear and rotational movement may thus be imparted from the kelly 225 to the drill string 260.

A platform 202 is provided for the derrick 220. The platform 202 extends above the earth surface 201 and may support rig hands along with various components of drilling equipment such as a rotary table, shale shakers, dope bucket, pipe handling equipment and the like (not shown). It is understood that the platform 202 shown in FIG. 2 is relatively schematic.

Placed below the platform 202 and the kelly drive section 227 but above the earth surface 201 is a blow-out preventer, or BOP 230. The BOP 230 is a large, specialized valve or set of valves used to seal, control and monitor oil and gas wells during drilling and completion. Blowout preventers control the erratic pressures emanating from a well reservoir as new formations are encountered. The BOP 230 may include upper 232 and lower 234 rams used to control pressure and isolate flow on the back side of the drill string 260. Blowout preventers 230 should also prevent the pipe joints making up the drill string 260 and the drilling fluid from being blown out of the wellbore 250 when a blowout threatens.

It is understood that other components will be used in connection with a drilling operation that are not shown. These may include, for example, a drill string safety valve for controlling pressure within the drill string, pressure gauges, mud pumps (and associated mud pits), and the like.

As shown in FIG. 2, the wellbore 250 is being formed down into the subsurface formation 255. In addition, the wellbore 250 is being shown as a deviated wellbore. Of course, this is merely illustrative as the wellbore 250 may be a vertical well or even a horizontal well.

In drilling the wellbore 250, a first string of casing 210 is placed from the surface 201. This is known as surface casing 210 or, in some instances (particularly offshore), conductor pipe. The surface casing 210 is secured within the formation 255 by a cement sheath. The cement sheath resides within an annular region 215 between the surface casing 210 and the surrounding earth formation 255.

During the process of drilling and completing the wellbore 250, additional strings of casing will be provided. These may include intermediate casing strings and a final production casing string (not shown). As the final production casing, a liner may be employed, that is, a string of casing that is not tied back to the surface 201.

As noted, the wellbore 250 is formed by using a bottom hole assembly 240. The bottom-hole assembly 240 allows the operator to control or "steer" the direction of the bit 242. The bottom hole assembly 240 will include the drill bit 242. The drill bit 242 may be turned by rotating the drill string 260 from the platform 202. Alternatively, the drill bit 242 may be turned by using so-called mud motors 244. The mud motors 244 are mechanically coupled to and turn the nearby drill bit 242. The mud motors 244 are used with stabilizers or bent subs 246 to impart an angular deviation to the drill bit 242. This, in turn, deviates the wellbore 250 from its previous path and in the desired azimuth and/or orientation to cut exposed rock 205. In this instance, the bottom hole assembly 240 is known as a rotary steerable drilling system, or RSS. The drill bit 242 and RSS 240 correlate to the drill bit 110 and RSS 120 of FIG. 1.

It is noted that rotary steerable drilling systems for drilling deviated boreholes into the earth may be generally classified as either "point-the-bit" systems or "push-the-bit" systems. In a point-the-bit system, the axis of rotation of the drill bit is deviated from the local axis of the bottom hole assembly ("BHA") in the general direction of the new hole being formed. The hole is propagated in accordance with a three-point geometry defined by an upper stabilizer touch point, a lower stabilizer touch point, and the drill bit. The angle of deviation of the drill bit axis coupled with a finite distance between the drill bit and the lower stabilizer results in the non-collinear condition required for a curve to be generated.

Various ways are known in which to create the non-collinear condition. These include providing a fixed bend at a point in the bottom hole assembly close to the lower stabilizer, and providing a flexure of the drill bit drive shaft that is distributed between the upper and lower stabilizers. In either of these arrangements, the drill bit is tilted compared to the axis of revolution of the borehole.

Pointing the bit may comprise using a downhole motor to rotate the drill bit, where the motor and the drill bit are mounted upon a drill string that includes an angled bend. In such a system, the drill bit may be coupled to the motor by a hinge-type or tilted mechanism/joint, or by a bent sub. In this way, the drill bit may be inclined relative to the motor and then pushed in a desired direction.

When variation of the direction of drilling is required, the rotation of the drill-string may be stopped and the bit may be positioned in the borehole. Using the downhole motor, rotation of the drill bit may start in the desired direction. As can be seen, in such an arrangement, the direction of drilling is dependent upon the angular position of the drill string. The drill bit is not necessarily required to cut sideways as the bit axis is continually rotated in the direction of the curved hole.

Examples of known point-the-bit RSS systems include the AutoTrak™ system offered by Baker Hughes Inc. of Houston, Tex., the Revolution™ system offered by Weatherford/Lamb, Inc. of Houston, Tex., the PDXCeed™ and the PDArcher™ systems offered by Schlumberger Limited of Sugar Land, Tex., and the GeoPilot™ tool offered by Halliburton Company of Houston, Tex.

As noted, the other directional drilling system is a push-the-bit system. Push-the-bit systems apply force against the borehole wall. This bends the drill-string and forces the drill bit to drill in a preferred direction. In a push-the-bit rotary steerable system, the requisite non-collinear condition is achieved by causing a mechanism to apply a force or create displacement in a direction that is preferentially oriented with respect to the direction of borehole propagation.

There are many ways in which this may be achieved. These include non-rotating (with respect to the hole), displacement based approaches and eccentric actuators that apply force to the drill bit in the desired steering direction. Steering may again be achieved by creating non-co-linearity between the drill bit and at least two other touch points. Ideally, the drill bit is able to cut sideways in order to generate a curved hole.

A push-the-bit system typically uses either an internal or an external counter-rotation stabilizer to provide a geo-stationary reference. The counter-rotation stabilizer remains at a fixed angle (or geo-stationary) with respect to the borehole wall. When the borehole is to be deviated, an actuator presses one or more pads against the borehole wall in the opposite direction from the desired deviation. The result is that the drill bit is pushed in the desired direction.

The force generated by the actuators/pads is balanced by the force to bend the bottom hole assembly. The force is reacted through the actuators/pads on the opposite side of the bottom hole assembly. The force acts on the cutters of the drill bit, thus "steering" the hole. In some situations, the force from the pads/actuators may be large enough to erode the formation where the system is applied.

An example of a known push-the-bit RSS system is the PDX6™ offered by Schlumberger Limited of Sugar Land, Tex.

Both point-the-bit and push-the-bit systems utilize complex working mechanisms to accomplish three-dimensional directional control. Both systems achieve directional control by creating an imbalance of force on the drill bit. Specifically, a greater force is applied to a select side of the drill bit, causing the drill bit to cut more rock in one direction than in another.

The performance of a rotary steerable drilling system is generally measured according to the dog-leg severity (or "DLS") capability of the device. DLS is measured in degrees per 100 feet. The DLS expresses how much the RSS can bend the trajectory of the borehole over a drilled length of 100 feet.

Typical DLS capabilities for RSS will vary between about 2 and 10 degrees/100 feet, depending on the hole and the tool diameter. Those of ordinary skill in the art will understand that the larger the tool diameter, the stiffer (less flexible) the tool will be. The result is that the tool is less "bendable." Therefore, slimmer tools are generally preferred to achieve higher DLS. At the same time, more bendable tools undergo a higher degree of strain as a higher DLS is pursued. The latest high end tools are capable of achieving a DLS of up to 15 in certain conditions. However, the steering units for these high end tools are susceptible to breakage. Specifically, great stresses are imparted onto the connections between collars, leading to earlier failure due to material fatigue.

When a tool breaks, the steering unit and drill bit may have to be left in the hole. Such drilling equipment is extremely expensive. At a minimum, expensive fishing attempts will be undertaken to retrieve the equipment. Both rig time and lost parts are costly. Therefore, it is desirable to offer a steering unit that is more durable while still offering a high DLS capability.

It is proposed herein to employ actuators that provide a force that translates into linear displacement. More specifically, it is proposed to employ a steering unit that uses actuators configured to direct a force of the drill bit against the rock formation, wherein the steering unit transforms electrical power into off-center, linear displacement and force. In one aspect, the actuators are Linear Piezo-Electric Actuators, or LPEA's, that are designed to deliver small displacements with large force in response to a voltage under low power. For example, each LPEA may respond to a 1,000 volt charge.

Figure 3A:
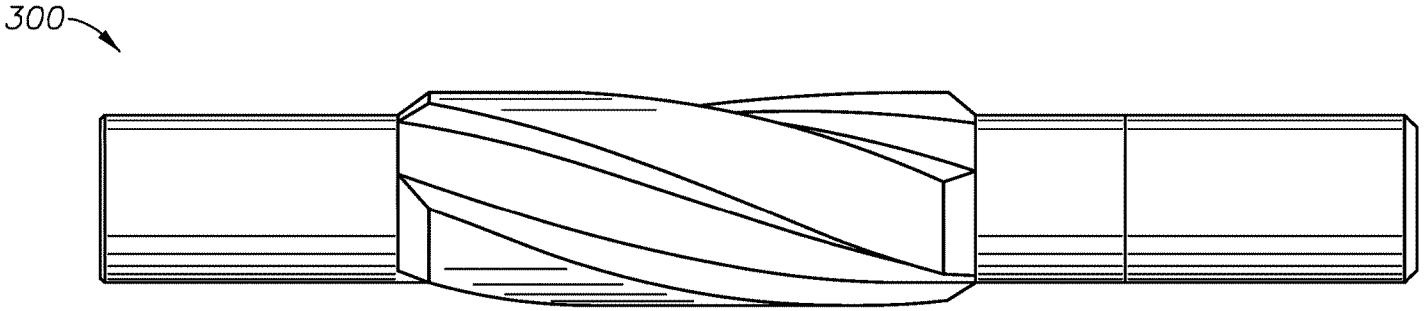
FIG. 3A is a side view of a steering unit to be used as the steering unit of the bottom hole assembly of FIG. 1 in forming a deviated wellbore, such as the wellbore of FIG. 2.
Figure 3B:
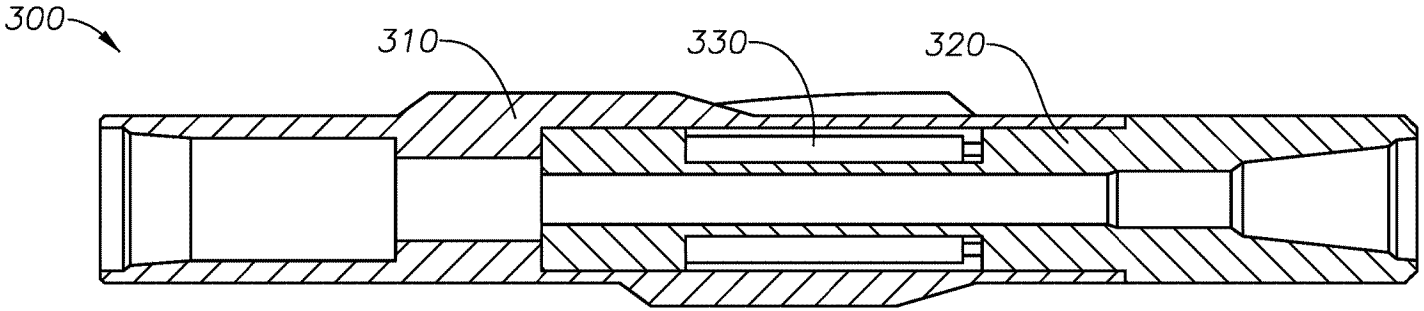
FIG. 3B is a side, cut-away view of the steering unit of FIG. 3A. The steering unit contains a linear actuator. In this view, the linear actuator is a stack of piezo-electric actuators.

One suitable LPEA product is available from Piezo-Mechanik GmbH of Munich, Germany. FIG. 3A provides a side view of a steering unit 300 containing one or more piezo-electric linear actuators. FIG. 3B is a side, cut-away view of the steering unit 300 of FIG. 3A. This shows a piezo stack integrated into a pre-loaded casing. The LPEA comes pre-wired and packaged to withstand shocks and vibrations inherent in the rock formation drilling process. The steering unit 300 is an example of the steering unit 150 of FIG. 1.

It is noted that for a six-inch steering unit, the Piezo-Mechanik PSt 1000/16/200 VS25 may be employed. This product will deliver a maximum force of 12 kN, and a maximum stroke of about 260 micrometers.

In one aspect, the steering unit 300 having an LPEA integrated therein is comprised of two collars 310, 320. A first collar 310 protects the LPEA from the pressure of the drilling environment (up to 1380 bars). A soft compliant elastomeric compound, such as 90D Viton o-rings, may be assembled between the lowest part of the first collar 310 where it meets with the second collar 320. This arrangement allows relative movement between the first 310 and second 320 collars.

In one aspect, the second collar 320 houses three LPEA's 330 stacked in series. The use of several LPEA's in series will increase actuation coverage over 360 degrees. When actuated, the LPEA's 330 will extend and bend the flexible tube of the second collar 320. This will enable pointing the connected drill bit in the desired direction.

A distance is preserved between the linear actuators and the drill bit connection. This provides an appropriate force leverage and displacement to the drill bit. The distance may be optimized for a desired DLS.

Figure 4A:
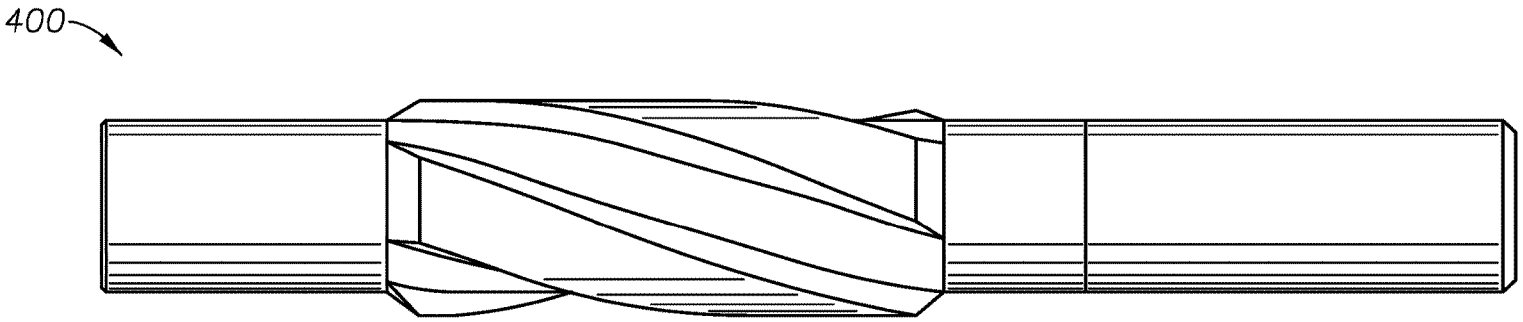
FIG. 4A is a side view of a linear actuator to be used as the steering unit of FIG. 1 in forming a deviated wellbore, in an alternate embodiment. Here, the actuator includes an added universal joint type connection.
Figure 4B:
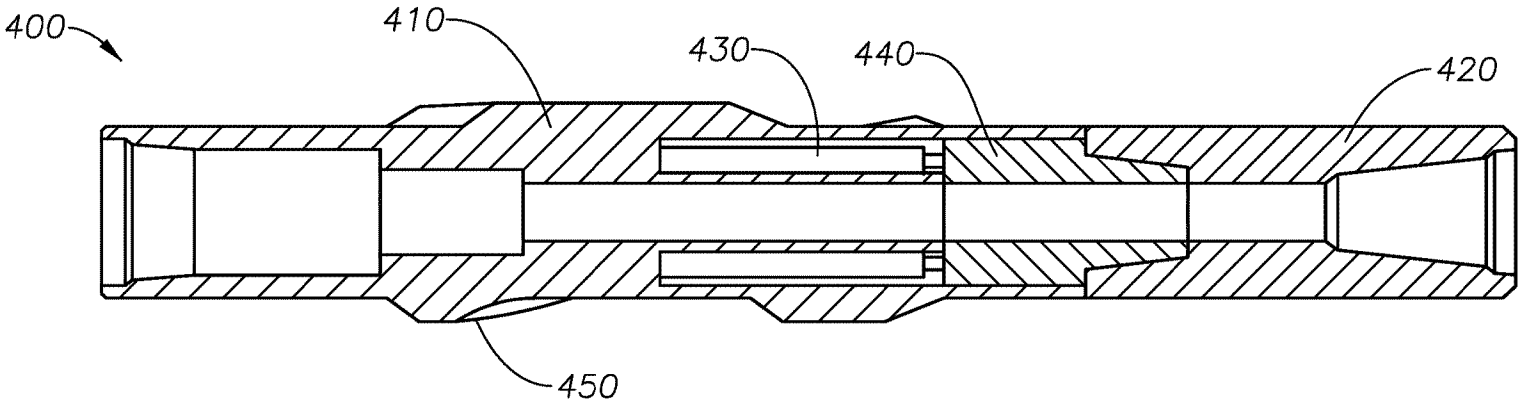
FIG. 4B is a side, cut-away view of the linear actuator of FIG. 4A. The linear actuator may be again be a piezo-electric actuator or a hydraulic cylinder actuator.

In some instances it is desirable to increase the tilt for the drill bit. Accordingly, FIG. 4A provides a side view of a steering unit 400 to be used as the steering unit 150 of FIG. 1 in forming a deviated wellbore, in an alternate embodiment. Here, the steering unit 400 includes an added universal joint type connection 440. FIG. 4B is a side, cut-away view of the steering unit 400 of FIG. 4A. The steering unit 400 again uses a piezo-electric actuator 430.

In the arrangement of FIGS. 4A and 4B, a universal joint 440 is provided. The universal joint 440 is a compliant connection that may be added between first 410 and second 420 collars of the steering unit 400. This adds a further degree of "pointing-the-bit" without having to bend the second collar 420.

The theory behind the capability of the steering unit 400 to propagate a deviated hole is that the actuators 430 will generate forces and displacements that are off-center compared to the geometric axis of the drill bit 110. These forces and displacements will be applied to the drill bit 110 by way of the second collar 420 and break the balance of the drilling action of the drill bit 110 and, in turn, the drill bit 110 will remove rock 205 in the preferred direction and propagate a deviated wellbore 250.

A stabilizer 450 shown here placed on the first collar 410 may be added on the steering unit 400. Alternatively, a further collar (not shown) may be added to optimize DLS capability by way of the leverage of the linear actuators.

In another embodiment, the LPEA's may be exposed to the drilling mud. This removes the sealing requirement. In this instance, the LPEA's are designed to withstand high bottom hole pressures and temperatures, and exposure to chemical compositions and fluids within the wellbore.

Other linear actuators may be used in lieu of the described LPEA. These include hydraulic actuators and pistons.

Figure 5A:
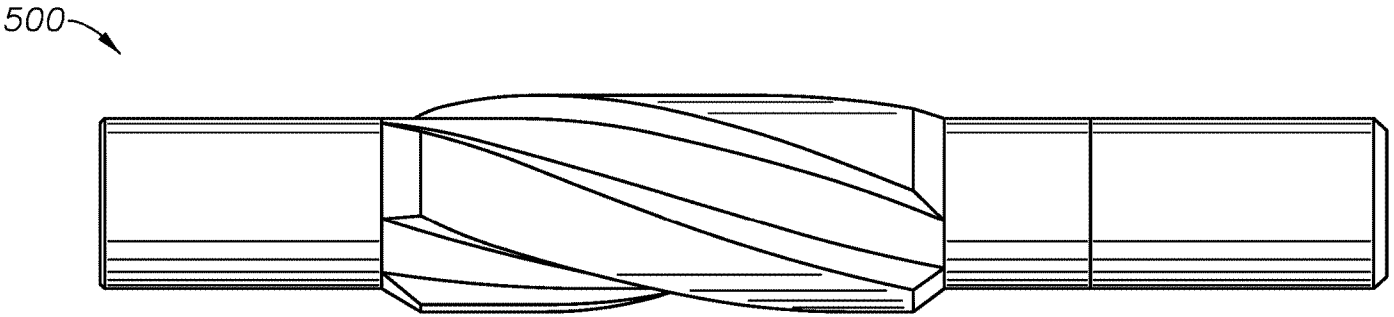
FIG. 5A is a side view of a linear actuator to be used as the steering unit of FIG. 1 in forming a deviated wellbore, in another alternate embodiment. Here, the actuator is a mud-driven piston linear actuator.
Figure 5B:
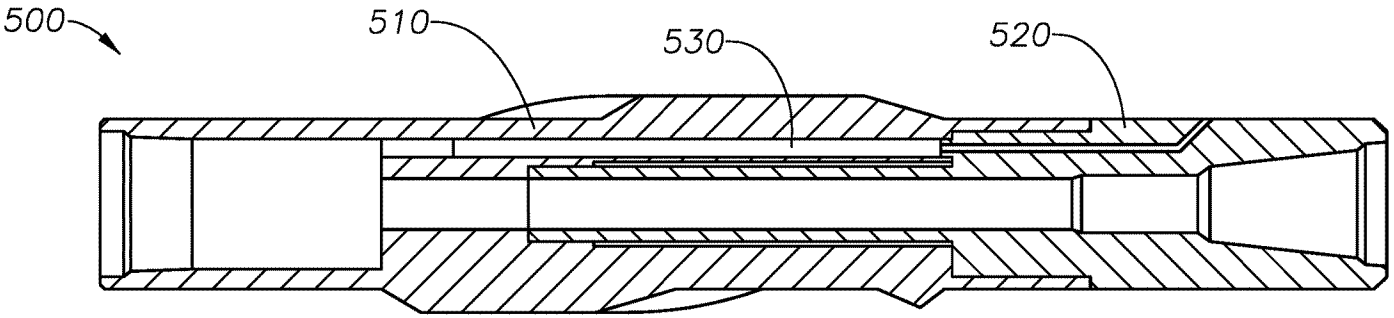
FIG. 5B is a side, cut-away view of the linear actuator of FIG. 5A.

FIG. 5A is a side view of a steering unit 500 in another alternate embodiment. The steering unit 500 may also be used as the steering unit shown at 150 in FIG. 1, and is used in forming a deviated wellbore 250. FIG. 5B is a side, cut-away view of the steering unit 500 of FIG. 5A. The steering unit 500 again is comprised of two collars 510, 520. Additionally, the steering unit 500 employs a mud-driven piston linear actuator 530. The pistons 530 are machined in the second collar 520, allowing hydraulic pistons to be used.

Electro-valves or other fluid actuators such as rotary valves may allow the drilling mud to flow inside channels in the first collar 510. The mud pressure is higher inside of the drill string 260 than outside of the drill string 260. This pressure is applied to the pistons 530. The force generated by the pistons 530 bends a flexible part of the second collar 520, thereby pointing the drill bit toward a preferred direction. A restriction or pinch point in the piston 530 provides a pressure drop consistent with that between the inside and outside of the drill string 260. The second collar 520 then releases the diverted mud flow to the annulus existing between the drilled hole and the steering unit 240.

Figure 5C:
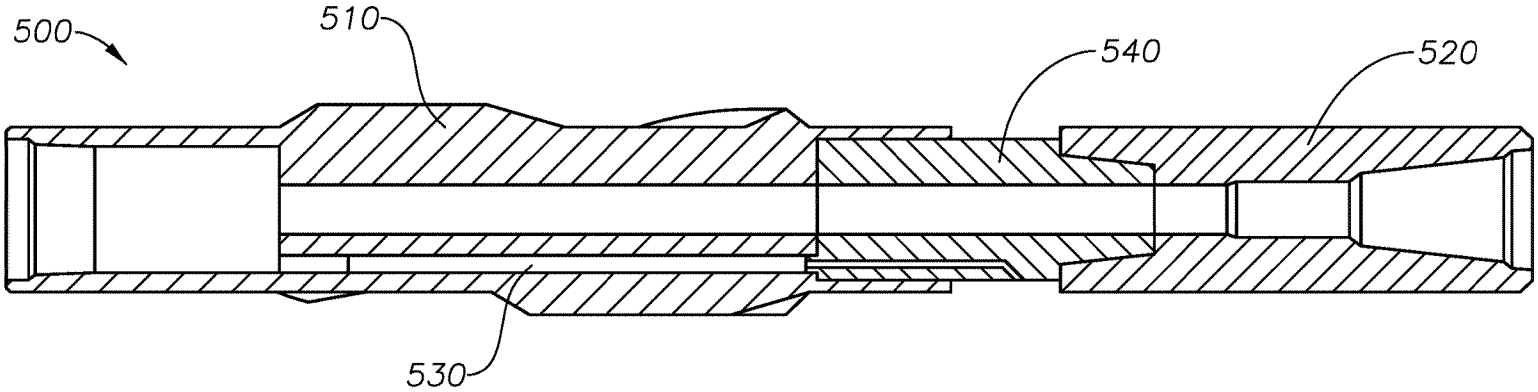
FIG. 5C is a side, cut-away view of the linear actuator of FIG. 5B, in a modified embodiment. Here, the actuator includes an added universal joint type connection.
Figure 6A:
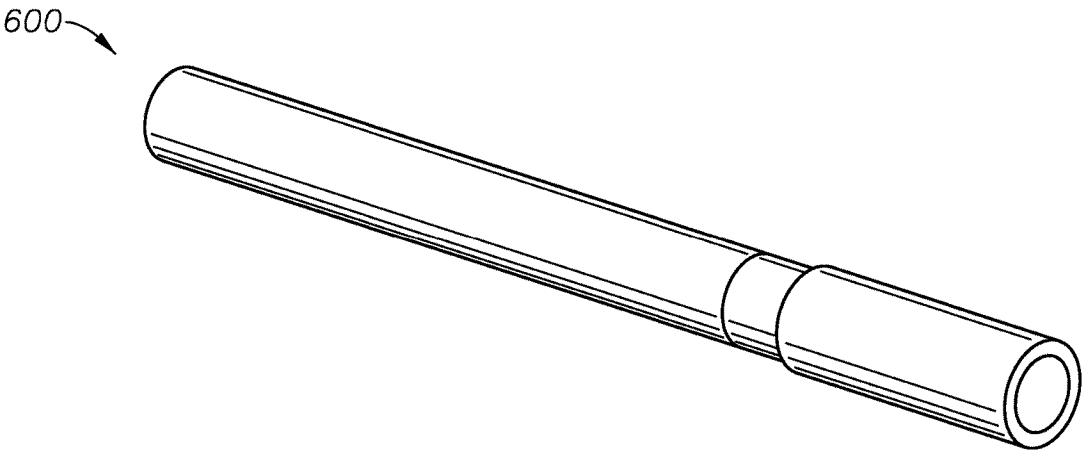
FIG. 6A is a perspective view of a linear actuator to be used as the steering unit of FIG. 1 in forming a deviated wellbore, in another alternate view. Here, first and second collars are shown.
Figure 6B:
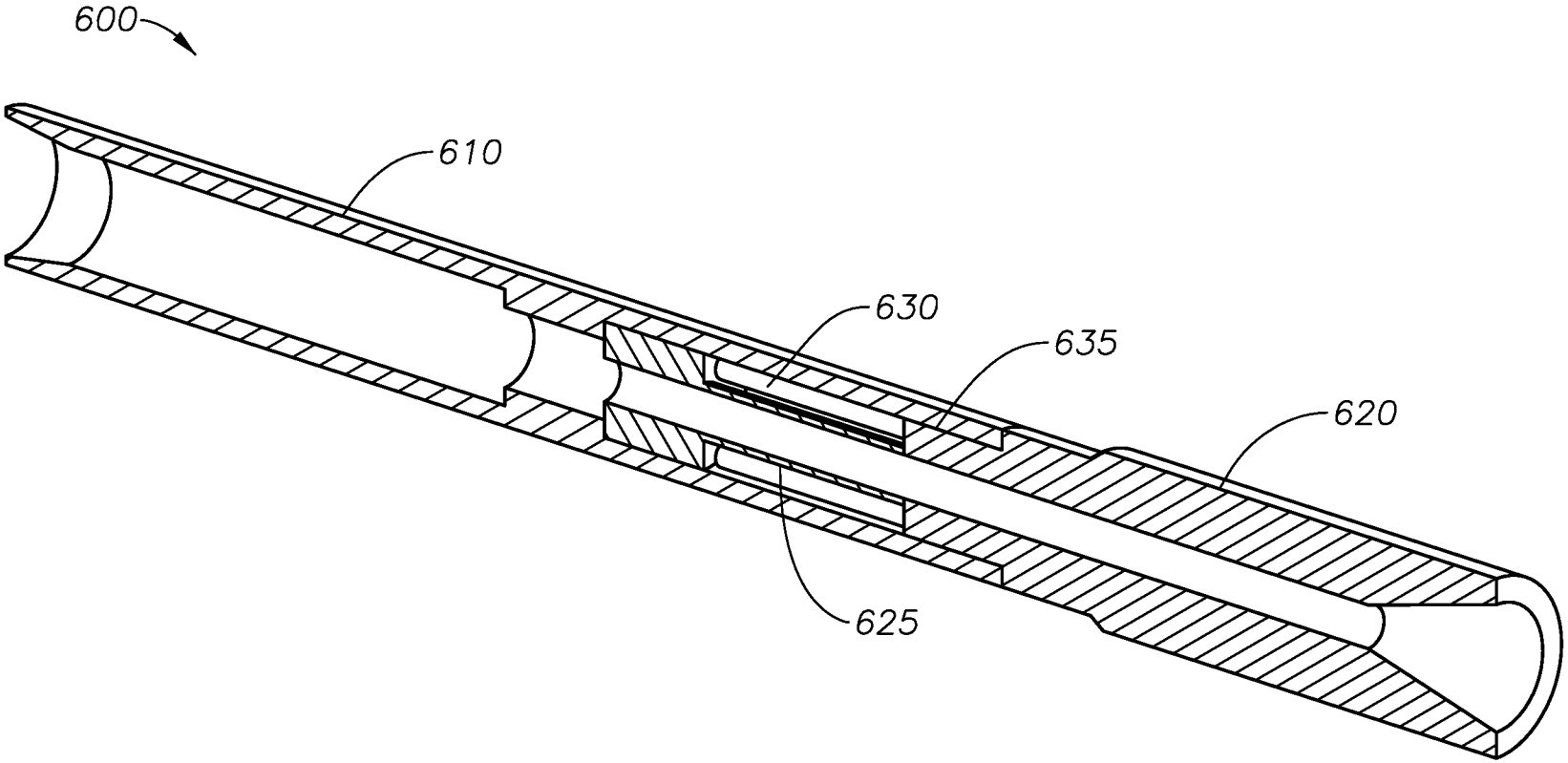
FIG. 6B is a side, cut-away view of the linear actuator of FIG. 6A.

FIG. 5C is a side, cut-away view of the steering unit 500 of FIG. 5B, in a modified embodiment. Here, the steering unit 500 includes an added universal joint type connection 540 for greater tilt of the drill bit 110. The universal joint 540 is a compliant connection that may be added below the second 520 collar to add a further degree of "pointing-the-bit" without having to bend the second collar 520. The universal joint 540 accommodates flexibility of the second collar relative to the first collar, and a tilting of the drill bit FIG. 6A is a perspective view of a linear actuator 600 to be used as the steering unit of FIG. 1 in forming a deviated wellbore, in another alternate view. Here, first 610 and second 620 collars are shown. FIG. 6B is a side, cut-away view of the linear actuator 600 of FIG. 6A.

The linear actuator 600 again uses a piezo stack. The piezo stack is shown within the second collar 620 at 630. Additionally, a soft compliant elastomeric compound 635 is provided between the lowest part of the first collar 610 and the second collar 620. When actuated, the LPEA's 630 will extend and bend the second collar 620 in its thinnest section 625. This enables pointing the drill bit 110 towards a desired direction.

In the preferred embodiment, at least three LPEA's are used in order to provide an appropriate actuation coverage over 360°.

The RSS designs provided in FIGS, 3B, 4B, 5B and 6B along with a suitable drill bit, can operate at 100 revolutions per minute (RPM's) or more, can achieve a rate of penetration (ROP) of 50 feet/hour or more, and can operate at 100 kN weight on bit (WOB). Further, the RSS designs are capable of applying around 10 kN of side force and several hundreds of micrometers of sideways displacement at the drill bit. Preferably, the linear piezo-electric actuators have a stroke length of about 200 to 260 micrometers.

The RSS designs of the present invention have the advantage of containing few parts, while being reliable and inexpensive to produce and maintain. The tool is scalable for larger boreholes. While it will be apparent that the inventions herein described are well calculated to achieve the benefits and advantages set forth above, it will be appreciated that the inventions are susceptible to modification, variation and change without departing from the spirit thereof.

I claim:

1. A bottom hole assembly, comprising:

a drill bit designed to cut a rock formation in a subsurface; and a point-the-bit rotary steerable drilling system for controlling the drill bit in order to form a deviated wellbore, wherein the rotary steerable drilling system comprises;

a power generator for generating electrical power, one or more orientation sensors, a steering unit configured to direct a force of the drill bit against the rock formation, wherein the steering unit comprises:

a first tubular collar having a proximal end and a distal end and forming a central bore there between, a second tubular collar also having a proximal end and a distal end and forming a central bore there between, wherein the proximal end of the second tubular collar is disposed adjacent a distal end of the first tubular collar, and with the distal end of the second tubular collar being operatively connected to the drill bit, an intermediate tubular member, wherein the intermediate tubular member:

comprises a proximal end, a distal end and a central bore there between that places the central bore of the first tubular collar in fluid communication with the central bore of the second tubular collar, the proximal end of the intermediate tubular member resides within an inner diameter of the first tubular collar at the distal end of the first tubular collar, and provides a flexible mechanical connection between the first tubular collar and the second tubular collar;

at least three recesses residing radially around a body of the first tubular collar and providing respective upper shoulders, wherein each of the recesses is substantially fluidically sealed from downhole fluids, and a piezo-electric actuator residing within each respective recess, with the piezo-electric actuators being designed and arranged to transform electrical power received from the power generator into off-center, linear displacement and force that is directed downwardly through the second tubular collar, wherein:

each piezo-electric actuator has a first end residing against the shoulder of the first tubular collar, and a second end that is configured to apply the downward force against the second tubular collar by acting against the proximal end of the intermediate tubular member, each piezo-electric actuator generates a longitudinal stroke of at least 200 μm, and the linear actuators are longitudinally spaced apart from the drill bit to preserve force leverage, control electronics designed to send control signals to the steering unit to actuate selected piezo-electric actuators to generate the force in a selected direction that is offset from a longitudinal centerline of the drill bit, and power electronics designed to process current and voltage generated by the power generator, and transform the current and voltage into values useful for providing power to the orientation sensors, the control electronics, and the steering unit.

2. The bottom hole assembly of claim 1, wherein the drill bit is a static bit body having cutting elements fixed thereon or impregnated therein.

3. The bottom hole assembly of claim 1, wherein the drill bit comprises one or more roller cones.

4. The bottom hole assembly of claim 1, wherein the power generator comprises a turbine that moves in response to a flow of drilling mud, and an alternator that transforms mechanical movement of the turbine into electrical power.

5. The bottom hole assembly of claim 1, wherein the one or more orientation sensors comprises (i) a set of accelerometers configured to determine an inclination of the rotary steerable drilling system relative to the earth's gravitational field during a wellbore drilling operation, (ii) a set of magnetometers configured to determine an inclination of the rotary steerable drilling system relative to the earth's magnetic field, or (iii) a combination thereof.

6. The bottom hole assembly of claim 5, wherein:

the steering unit is capable of up to a 15° /100 feet deviation (DLS capability); and the longitudinal distance between the linear actuators and the drill bit is optimized for a desired DLS capability.

7. The bottom hole assembly of claim 6, wherein the steering unit is designed to apply about 10 kN side force.

8. The bottom hole assembly of claim 6, wherein the steering unit is designed to apply up to about 3 to 5 μm side displacement at the drill bit.

9. The bottom hole assembly of claim 6, wherein:

each of the at least three piezo-electric actuators comprises a stack of at least two piezo-electric actuators placed in series for directing the off-center, linear displacement and force through the second tubular collar; and the intermediate tubular member comprises a compliant material to facilitate the flexibility of the second tubular collar relative to the first tubular collar.

10. The bottom hole assembly of claim 9, wherein the piezoelectric actuators are configured to receive charges of about 1,000 volts from the power electronics.

11. The bottom hole assembly of claim 9, wherein the steering unit further comprises:

comprises (i) compliant o-rings between a lower end of the first tubular collar and an upper end of the second tubular collar, (ii) a compliant body forming at least an upstream portion of the second tubular collar, or (iii) both.

12. The bottom hole assembly of claim 11, wherein the steering unit further comprises a compliant connection between the second tubular collar and the drill bit to provide added tilting to the drill bit relative to a center-line of the assembly when the piezo-electric actuators are activated.

13. The bottom hole assembly of claim 1, wherein the steering unit is designed to operate at a downhole temperature up to at least about 200° C.

14. A method for forming a deviated wellbore, comprising:

using a drill string and a drill bit disposed at a lower end of the drill string, forming a vertical portion of a wellbore through an earth subsurface;

drilling the wellbore to a kick-off point;

providing a point-the-bit rotary steerable drilling system at a lower end of the drill string for controlling the drill bit in order to form a deviated wellbore, wherein the rotary steerable drilling system comprises:

a power generator for generating electrical power, one or more orientation sensors, a steering unit configured to direct a force of the drill bit against the rock formation, wherein the steering unit comprises:

a first tubular collar having a proximal end and a distal end and forming a central bore there between, and having a shoulder formed along an inner diameter, a second tubular collar also having a proximal end and a distal end and forming a central bore there between, wherein the proximal end of the second tubular collar abuts the shoulder of the first tubular collar within the bore of the first tubular collar, and with the distal end of the second tubular collar being operatively connected to the drill bit, an annular recess formed along an outer diameter of the second tubular collar and within the inner diameter of the first tubular collar, thereby providing an upper shoulder and a lower shoulder, and at least three piezo-electric actuators arranged radially within the annular recess and which are designed to transform electrical power into off-center, linear displacement and force that is directed downwardly through the second tubular collar, wherein:

the first tubular collar and the second tubular collar are flexibly connected, each piezo-electric actuator has a first end residing against the upper shoulder of the second tubular collar, and a second end that applies the downward force against the lower shoulder of the second tubular collar, each piezo-electric actuator generates a longitudinal stroke of at least 200 μm, and the linear actuators are longitudinally spaced apart from the drill bit to preserve force leverage, control electronics designed to send control signals to the steering unit to actuate selected piezo-electric actuators to generate the off-center force in a selected direction that is offset from a longitudinal centerline of the drill bit, and power electronics designed to process current and voltage generated by the power generator, and transform the current and voltage into values useful for providing power to the orientation sensors, the control electronics, and the steering unit;

introducing the drill bit and rotary steerable drilling system into the wellbore;

rotating the drill bit; and forming a deviated portion of the wellbore from the kick-off point.

15. The method of claim 14, wherein the power generator comprises a turbine that moves in response to a flow of drilling mud, and an alternator that transforms mechanical movement of the turbine into electrical power.

16. The method of claim 14, wherein the one or more orientation sensors comprises (i) a set of accelerometers configured to determine an inclination of the rotary steerable drilling system relative to the earth's gravitational field during a wellbore drilling operation, (ii) a set of magnetometers configured to determine an inclination of the rotary steerable drilling system relative to the earth's magnetic field, or (iii) a combination thereof.

17. The method of claim 16, wherein:

the steering unit is capable of up to a 15 ° /100 feet deviation (DLS capability); and the longitudinal distance between the linear actuators and the drill bit is optimized for a desired DLS capability.

18. The method of claim 17, wherein the steering unit further comprises a soft compliant material to facilitate the flexible connection between the second tubular collar and the first tubular collar.

19. The method of claim 18, wherein the soft compliant elastomeric compound is placed (i) along the distal end of the first tubular collar, or (ii) along the second tubular collar below the lower shoulder to provide the flexibility of the second tubular collar relative to the first tubular collar, and to accommodate tilting of the drill bit relative to a center-line of the system.

20. The method of claim 18, wherein:

the compliant material comprises (i) o-rings between a lower end of the first tubular collar and an upper end of the second tubular collar, (ii) a compliant body forming at least an upstream portion of the second tubular collar adjacent the piezo-electric actuators, or (iii) both; and each of the at least three piezo-electric actuators comprises a stack of at least two piezoelectric actuators placed in series for directing the off-center, linear displacement and force through the second collar.

21. A bottom hole assembly, comprising:

a drill bit designed to cut a rock formation in a subsurface; and a point-the-bit rotary steerable drilling system for controlling the drill bit in order to form a deviated wellbore, wherein the rotary steerable drilling system comprises;

a power generator for generating electrical power, one or more orientation sensors, a steering unit configured to direct a force of the drill bit against the rock formation, wherein the steering unit comprises:

a first tubular collar having a proximal end and a distal end and forming a central bore there between, and having a shoulder formed along an inner diameter, a second tubular collar also having a proximal end and a distal end and forming a central bore there between, wherein the proximal end of the second tubular collar abuts the shoulder of the first tubular collar within the bore of the first tubular collar, and with the distal end of the second tubular collar being operatively connected to the drill bit, an annular recess formed along an outer diameter of the second tubular collar and within the inner diameter of the first tubular collar, thereby providing an upper shoulder and a lower shoulder, and at least three piezo-electric actuators arranged radially within the annular recess and which are designed to transform electrical power into off-center, linear displacement and force that is directed downwardly through the second tubular collar, wherein:

the first tubular collar and the second tubular collar are flexibly connected, each piezo-electric actuator has a first end residing against the upper shoulder of the second tubular collar, and a second end that applies the downward force against the lower shoulder of the second tubular collar, each piezo-electric actuator generates a longitudinal stroke of at least 200 μm, and the linear actuators are longitudinally spaced apart from the drill bit to preserve force leverage, control electronics designed to send control signals to the steering unit to actuate selected piezo-electric actuators to generate the force in a selected direction that is offset from a longitudinal centerline of the drill bit, and power electronics designed to process current and voltage generated by the power generator, and transform the current and voltage into values useful for providing power to the orientation sensors, the control electronics, and the steering unit.

* * * * *